United States Patent [19]

Turillon

[11] 4,065,302

[45] Dec. 27, 1977

[54] POWDERED METAL CONSOLIDATION METHOD

[75] Inventor: Pierre Paul Turillon, Ramsey, N.J.

[73] Assignee: The International Nickel Company, Inc., New York, N.Y.

[21] Appl. No.: 644,586

[22] Filed: Dec. 29, 1975

[51] Int. Cl.[2] ..... B22F 3/14

[52] U.S. Cl. ..... 75/208 R; 75/223; 75/226

[58] Field of Search ..... 75/226, 208 R, 214, 75/223; 29/182.2, 182.3, 470.9

[56] References Cited

U.S. PATENT DOCUMENTS

| | | | |
|---|---|---|---|
| 2,775,029 | 12/1956 | Bennett et al. | 29/474.3 |
| 2,786,265 | 3/1957 | Keay | 29/470.9 |
| 2,813,332 | 11/1957 | Keay | 29/471.5 |
| 2,908,966 | 10/1959 | Wagner | 29/194 |
| 2,908,969 | 10/1959 | Wagner | 29/470.9 |
| 3,015,885 | 1/1962 | McEuen et al. | 29/470.9 |
| 3,018,543 | 1/1962 | Beck | 29/157.3 |
| 3,034,204 | 5/1962 | Grenell et al. | 29/157.3 |
| 3,060,557 | 10/1962 | Rostoker et al. | 29/194 |
| 3,121,949 | 2/1964 | Wright | 29/471.5 |
| 3,125,805 | 3/1964 | Horigan | 29/472 |
| 3,284,195 | 11/1966 | Googin et al. | 75/226 |
| 3,340,101 | 9/1967 | Fields et al. | 148/11.5 |
| 3,519,419 | 7/1970 | Gibson | 75/171 |
| 3,574,002 | 4/1971 | Hayden et al. | 148/37 |
| 3,578,511 | 5/1971 | Mehl et al. | 148/11.5 |
| 3,595,060 | 7/1971 | Hundy | 148/11.5 X |
| 3,689,325 | 9/1972 | Hayden et al. | 148/12 |
| 3,773,506 | 11/1973 | Larker et al. | 75/226 |

OTHER PUBLICATIONS

Boyer et al., "Solid State Bonding and Consolidation of Powders Under Hot-Isostatic Pressure", ASME pub. 71-WA/Prod-20, 1971.

Smith et al., "Design of a Superplastic Alloy Steel", In Metals Technology, Apr. 1974, pp. 191-198.

Petersen et al., "Forming Superplastic Alloys by Internal Pressure", In Metals Eng. Quar., Feb. 1975, pp. 31-32.

*Primary Examiner*—Richard E. Schafer

*Attorney, Agent, or Firm*—Walter A. Petersen; Ewan C. MacQueen; Raymond J. Kenny

[57] ABSTRACT

A method for compressing and sintering metal powder into solid form for use as metal coatings and structures. Metal powder is enclosed in a pressure-resistant container in contact with a metal bladder. The bladder contains a heat-decomposable substance which upon heating provides gaseous pressure to expand the bladder and compress and sinter the metal powder. The compressed and sintered metal powder can be used as a metal coating upon a metal surface or as a solid metal article by removal of the surface on which the metal powder was formed.

11 Claims, 1 Drawing Figure

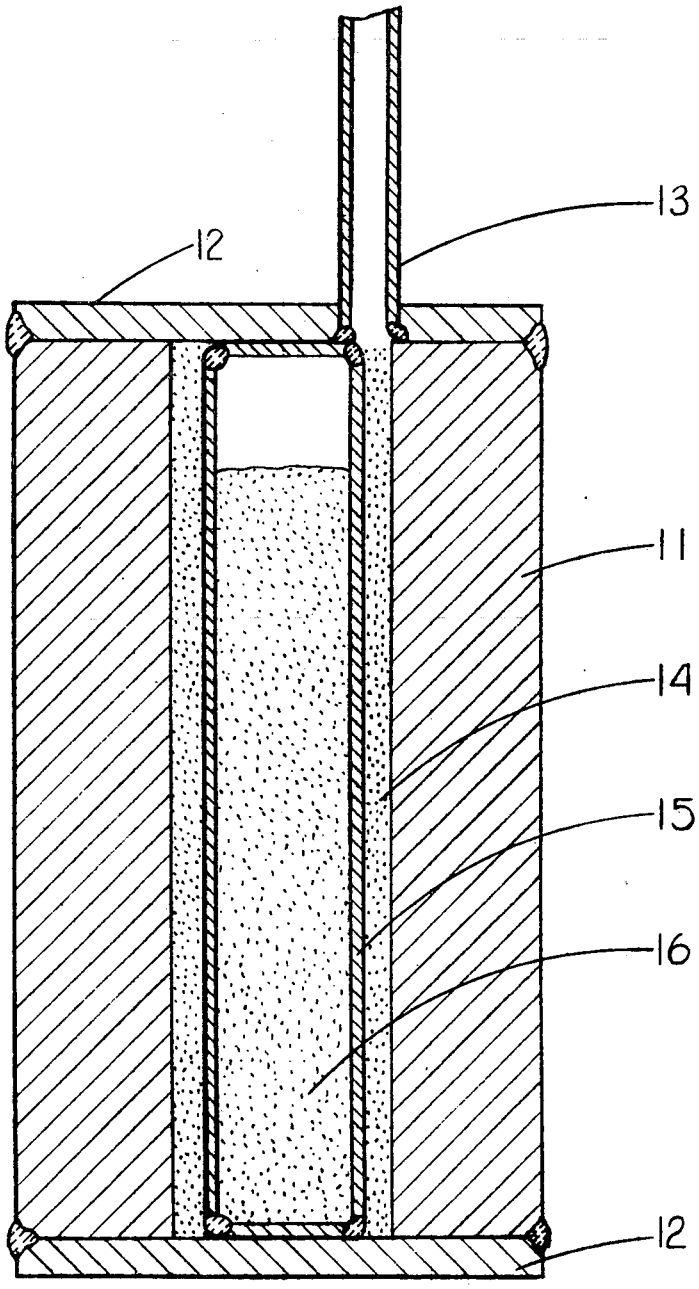
13
12
11
14
15
16
12

POWDERED METAL CONSOLIDATION METHOD

The invention relates to a method for compressing and sintering metal powders into solid form for use as metal coatings and structures.

It is highly desirable to be able to coat the surface of a metal article with a second metal possessing distinctly advantageous properties. For example, a corrosion-resistant liner of titanium in a high strength steel pump body would be highly useful in the transmission of corrosive liquids. Also, coatings for tubular members exposed to carburizing and sulfidizing environments on the inside and having a high-strength oxidation-resistant outer surface would be attractive to the power industry. However, such combinations of materials, although highly desirable, are not easily manufactured because of the dissimilarity in the properties of such metals. Various means for applying coatings have been devised, however, limitations exist with each presently known method.

To illustrate, weld overlaying is commonly used to coat internal surfaces of articles of manufacture such as pulp digesters, but such cladding requires essentially flat or cylindrical surfaces having little detail. There are also size limitations for such internal linings which are related to access by welding equipment. Similar limitations apply to the related processes, flame and plasma spraying which, although useful for internal cladding, provide coatings that may not be dense enough or thick enough for many applications. Welding and spraying methods can not be readily used to apply coatings of reactive metals such as titanium.

Although generally used on flat plate, explosive bonding and braze bonding are other methods that may be used for internal cladding. However, these processes are of limited use for internal cladding since they require precise mating of part and cladding.

Hot isostatic-pressing is generally considered useful for forming powdered metal articles and is also useful for external metal cladding. It is conceivable that this process could also be used for the internal cladding of metal articles; however, the equipment used with this process is extremely sophisticated and requires considerable capital investment.

Composite tubing can be prepared by simultaneous extrusion of a powdered metal and a solid shell. This method is applicable to many materials but in the case of a reactive metal, such as titanium, there is a severe hazard involved in the exposure of the hot powdered metal to air. Severe fires of explosive nature can result and as a consequence this method is avoided.

It has now been discovered that dense metal structures can be formed at an elevated temperature by using a high pressure gas contained within a metal bladder to compact a body of metal powder for use as a coating on a second metal surface or as a solid structure.

Objects and advantages of this invention will become apparent from the drawing taken in view of the following description in which FIG. 1 depicts a cross-sectional view of a completed assembly prior to heating that could be useful for coating an internal metal surface or for forming a solid structure.

Generally speaking, the present invention is directed to a process for compressing and sintering metal powder into a solidified structure comprising: enclosing a body of metal powder within a pressure-resistant container; providing adjacent to said metal powder and within said pressure-resistant container, a metal bladder containing a heat-decomposable compound adapted upon decomposition to release a gas within said metal bladder to expand said metal bladder and apply pressure to said metal powder; heating said pressure-resistant container above the decomposition temperature of said heat-decomposable compound and in the sintering temperature region for said metal powder to expand said metal bladder and compress and sinter together said metal powder.

In one preferred embodiment, the process of this invention is used to prepare metal coatings on a metal surface. In this embodiment the process comprises the steps of: providing adjacent to a metal surface to be coated a body of metal powder having a composition to provide the metal coating; providing a metal bladder containing a heat-decomposable compound, adapted upon decomposition to release a gas, therein in contact with the body of metal powder; surrounding the metal powder, the metal surface to be coated and the metal bladder with a pressure-resistant container; and heating a resulting assembly to a temperature above the decomposition temperature of the heat-decomposable compound and in the sintering temperature region for the metal powder to expand the metal bladder and compress and sinter the metal powder against the metal surface.

It is preferred that the metal bladder (formable metal insert) contain a decomposable substance that will provide, by decomposition, a gaseous pressurizing medium at an elevated temperature coincident with the temperature range within which the metal of the metal bladder is highly ductile, e.g., exhibits elongation in excess of about 150%.

For operation at temperatures in the vicinity of 980° C, a metal bladder can be used that is made from superplastic alloys such as the stainless steel containing about 18 to 35% Cr, 2 to 12% Ni, less than 0.08% C, described in U.S. Pat. No. 3,574,002 or superplastic nickel-containing alloys containing about 19 to 60% Ni, 34 to 55% Cr, up to 55% Fe, up to 2.5% Ti, such as those described in U.S. Pat. No. 3,519,419 or even superplastic low alloy steels such as those containing about 4% Ni, 3% Mo, 1.6% Ti, Bal. Fe, described in Metals Technology, April 1974, page 191. The superplastic property available in such preferred alloys, which have a melting temperature in excess of about 1370° C, allows extensive elongation at temperatures of about 815° C to about 980° C. For example, tensile specimens prepared from such alloys and tested within the superplastic temperature range, e.g., 925° C, exhibit uniform elongation values of from about 150% to about 700% and even 1000%. Superplastic metals are generally characterized by a fine grain equiaxed microstructure, a high deformation temperature and a high strain-rate sensitivity of flow stress. The metal selected for use as the bladder should exhibit superplastic behavior at a temperature about equal to or somewhat below the sintering temperature of the metal powder used for the coating.

Where a metal bladder capable of only limited deformation as a result of internally generated pressure can be used, other materials such as mild steel and copper could conceivably be used; however, tests of these materials have shown them to be of only limited utility for this purpose due to the restricted ductility of these alloys, e.g., at most about 60% elongation in the tensile test at temperatures circa 815° to 980° C.

Calcium carbonate is the preferred heat-decomposable substance since it: (i) begins to decompose to provide pressurization at temperatures at which superplastic metals can withstand considerable deformation, e.g., above 815° C, (ii) is readily available, (iii) is relatively inexpensive, (iv) is non-corrosive to the metal bladder, and (v) provides a reversible chemical reaction which provides requisite pressure within the operating temperature range with reduction of pressure on cooling by recombination of the active pressurizing agent, carbon dioxide.

Other alkaline earth metal carbonates, alkali metal carbonates and metal carbonates can also be used to provide the pressurization required by this process; however, such carbonates are generally more expensive and not as readily available as calcium carbonate. Those skilled in the art will also realize that other compounds that decompose at elevated temperatures may be used as the heat-decomposable substance. Magnesium hydride, calcium nitrate and barium sulfate are examples of such substances that could be of use to this process. However, substances such as water which can be used to provide pressurization by conversion to a gaseous phase are generally considered to be unsatisfactory since excessive gas pressure is produced at too low a temperature, e.g., where the metal bladder performs as a conventional metal and not superplastically, with enhanced potential for rupture of the metal bladder.

It is preferred to have the shape of the metal bladder substantially coincide with the general shape of the metal surface to be coated to that a final substantially uniform coating thickness results. This may be accomplished by cold- or hot-forming the metal bladder as required prior to placement adjacent to the metal surface to be coated.

Virtually any metal surface can be coated with a second metal if a capability exists for bonding between the metal powder and the metal surface. For example, the surface of a metal article, the metal selected from a group consisting of steels, maraging steels, stainless steels, cast irons, copper-nickel alloys and nickel-containing alloys, can be coated with powdered metal selected from a group consisting of titanium, titanium alloys, zirconium, stainless steels, abrasion-resistant alloys, nickel-containing alloys, and copper-nickel alloys. These coating metals generally have a melting point of at least about 1090° C.

One of the typical and preferred areas for the use of this process is the titanium coating of surfaces of new, or for reconditioning of previously used, valves and fittings made of stainless steel. Internal coating of such items can make them better suited for handling severely corrosive fluids. In this particular type of application it has been found that the metal surface being coated should contain from about 15% to about 25% Cr or a suitable diffusion barrier should be present on the surface of the steel. A suitable diffusion barrier can be prepared using metals such as Cr, V, Co, Mo and Ni which, as is well known to those skilled in the art, can be applied by electrodeposition, vapor deposition, powder metallurgy techniques and etc. Such a diffusion barrier prevents formation of a brittle bond between the steel and the titanium coating. For the coating of steels with titanium or for high nickel alloys, temperatures from about 815° C to 1315° C have been found to be useful, preferably from about 980° C to about 1260° C, and most advantageously, from about 1065° C to about 1175° C. The corrosion resistance of the coatings is generally equivalent to that of the metal being applied as long as the density of the coating approaches the theoretical density of the solid metal. The attainment of 100% theoretical density is dependent on the pressing and sintering characteristics of the metal powder employed.

It may be desirable to remove the metal bladder following heating and expansion. The bladder can be removed by any suitable means such as mechanical separation, chemical-solution and machining.

The operation of a preferred embodiment of the process of this invention will be more clearly understood from a description of the drawing shown in the FIGURE. The metal article to be lined 11, which also serves as a pressure-resistant container, has at least one end plate 12. At least one of the end plates can contain a vent 13 in the form of a small diameter metal tube. The metal powder 14 to be bonded to the internal surfaces of the pipe surrounds the metal bladder 15 which is located centrally by appropriate fixturing to assure a uniform coating thickness. It is preferred that the ends of the metal bladder be restrained to promote circumferential rather than lateral expansion of the bladder during elevated temperature exposure. The metal bladder contains the decomposable substance 16 that decomposes on heating to provide the pressurizing medium at elevated temperature and preferably is calcium carbonate.

To produce a coating on a metal surface of such a metal article, it is preferred that the metal bladder be located centrally within the cavity of the metal article by the use of suitable positioning fixtures and then surrounded with metal powder. The closure pieces are subsequently welded to the metal article to provide a pressure-tight assembly. A vacuum pump can be attached to the vent, if desired, and a vacuum drawn on the system to remove entrained air from the metal powder. When a vacuum has been drawn, e.g., 2 pascal, the vent is sealed off by heating to an appropriate temperature, e.g., 980° C, and crimping the tube, thus sealing off the vacuum, and subsequently welding the tube shut to prevent entrance of air during further processing.

Although evacuation of the metal article to be coated is preferred since it provides better consolidation of the metal powder and also improves bonding, it is contemplated that this treatment is not absolutely essential. Where oxides and nitrides can be tolerated in the metal coating in an amount corresponding to that present in the assembled metal article, e.g., a copper-nickel coating on steel, the assembly can be sealed without evacuation and heated to the sintering and bonding temperature. A getter, e.g., small quantity of titanium, can be used to limit the residual oxygen and nitrogen within such an assembly.

Heating of the assembly causes simultaneous pressurization of the metal bladder due to decomposition of the heat-decomposable compound, e.g., $CaCO_3$ decomposes to $CaO + CO_2$, and sintering of the metal powder to itself as well as bonding to the surface of the metal article. For titanium coating of stainless steels, temperatures are used ranging from about 815° C to about 1315° C for time periods ranging from about ½ hour to about 24 hours. The assembly can be cooled rapidly to room temperature for disassembly after pressing and sintering; however, slow cooling has been found to be advantageous where the formation of intermetallic compounds of a brittle nature occurs, since slow cooling serves to minimize stresses due to differences in coefficients of thermal expansion of the two layers. Such intermetallic compounds can form as a result of excessive holding times at elevated temperatures, e.g., the intermetallic compound FeTi may be present in excessive amounts and cause brittleness after about 6 hours at 1090° C in titanium clad steel.

The invention also contemplates a two-temperature treatment. Heating to the first temperature, i.e., 815° to 980° C, causes expansion of the metal bladder and initial compaction and sintering of the metal powder. Increasing the temperature, i.e., heating to 1090° to 1315° C, results in additional decomposition of the pressurizing medium. This causes greater pressure to be applied to the powdered metal and leads to further densification.

After the passage of sufficient time at elevated temperature to effect densification, sintering and bonding of the powdered metal, the metal article is removed from the heat source. The pressure-resistant container or closure pieces are removed from the coated metal article and the metal bladder can be removed by mechanical separation, acid solution, machining or other suitable means, if desired.

The process of this invention can also be used to form solid metal articles from metal powders. The superplastic alloy bladder containing a heat-decomposable compound can be used to compress a body of metal powder against a molding surface contained within a pressure-resistant container. The molding surface provides a mirror image of the part to be formed and can be made of a metal or a ceramic (preferably a leachable ceramic). Following heating of the assembly with resultant expansion of the bladder and compression and sintering of the metal powder in a manner as described previously herein, the pressure-resistant container, molding surface and bladder are removed by mechanical separation or machining or chemical solution or a suitable combination of these methods. The result is a solid metal article requiring little machining prior to installation and use.

For the purpose of giving those skilled in the art a better understanding of the invention, the following illustrative examples are given:

EXAMPLE I

This example illustrates the internal coating with commercially pure titanium of a 15.2 cm long type 316 stainless steel (19% Cr, 12% Ni, 3% Mo, Bal. Fe) pipe having 8.9 cm outside diameter and 3.8 cm inside diameter.

A 14.9 cm long 26% Cr, 6% Ni stainless steel tube known to exhibit superplastic behavior at elevated temperature and having a 2.54 cm outside diameter and 1.6 mm wall was closed at one end by welding in place a 1.6 mm thick, 2.54 cm diameter disc also prepared from the superplastic stainless steel. This metal bladder was partially filled with 17 grams of reagent grade calcium carbonate and the remaining open end was sealed by welding in place a second 1.6 mm thick disc. The sealed metal bladder formed in the aforedescribed manner was located centrally within the cavity of the 8.9 cm outside diameter pipe which had been previously closed at one end by welding in place a 6.4 mm thick, 8.9 cm diameter stainless steel plate. Chemically pure titanium powder, minus 100 U.S. Sieve Series size and having an apparent density of 1.38 gm/cm$^3$, was poured into the pipe to surround the 26% Cr, 6% Ni stainless steel insert. A second 6.4 mm thick, 8.9 cm diameter stainless steel plate having a 12.7 cm long, 1 cm diameter steel evacuation tube welded thereto was placed over the remaining open end of the stainless steel pipe and welded in place completing the assembly.

The evacuation tube was connected to a mechanical vacuum pump and the assembly evacuated for 1 hour to a pressure of about 2 pascal. The evacuation tube was subsequently heated to a red heat with an oxyacetylene torch and crimped to effect a seal in two areas. The crimped area furthest removed from the steel pipe was then heated to its melting temperature and fused shut to completely seal the contents of the assembly from the atmosphere.

The assembly was subsequently placed in a furnace at an initial temperature of 260° C and raised to 1090° C in a time period of about 2 hours. It was held at 1090° C for 4 hours, removed from the furnace and cooled to room temperature.

Upon removal of the end plates, it was found that the loose titanium powder had compacted and sintered to provide a dense 2.4 mm thick coating bonded to the heavy-walled stainless steel pipe. Metallographic examination of a cross section of the coated pipe confirmed compaction and sintering and showed that there was a good metallurgical bond between the titanium liner and the heavy-walled stainless steel pipe. The density of the coating was found to be 4.52 gm/cc or 100% of theoretical density. The corrosion resistance of the coating was examined in 10% $H_2SO_4$ solution at 80° C and found to be equivalent to that exhibited by commercially pure wrought titanium.

EXAMPLE II

Density measurements were made on the titanium cladding of tubes prepared in the same way as the assembly described in Example I. Representative samples were cut from the 8.9 cm outside diameter, 3.8 cm inside diameter tubes and density determined by measuring weight in air and weight in water. Table I shows the results of tests at temperatures of 980° C and 1090° C for time periods of 1, 3 and 4 hours. The density of pure titanium is 4.51 gm/cc, and this value was substantially achieved in the tests conducted at 1090° C.

TABLE I

Coating Density as Affected by Temperature and Time

| Test | Temperature, ° C | Time, Hours | Density gm/cm$^3$ |
|---|---|---|---|
| 1 | 980 | 1 | 2.82 |
| 2 | 980 | 3 | 2.35 |
| 3 | 1090 | 1 | 4.58 |
| 4 | 1090 | 4 | 4.58 |

EXAMPLE III

This example shows that the desired degree of bonding required between titanium and steel can best be achieved using the process of this invention in steels containing between about 11% and about 30% chromium as previously reported in U.S. Pat. No. 2,786,265 or by the use of a chromium interlayer between a low alloy steel and the titanium layer.

The effect of chromium was studied on the bonding of titanium using 10.2 cm long, 8.9 cm outside diameter, 3.8 cm inside diameter tubing. The tubes were prepared from steels having 5% to 30% chromium as shown in Table II. Superplastic stainless steel bladders similar to those described previously, but 9.8 cm long, were used in these tests. The assemblies were evacuated to about 2 pascal, sealed by welding and heated to 1090° C for 4 hours.

Table II shows that excellent bonding occurs between the titanium inner layer and the steels containing 15%, 20%, and 25% chromium. Also an excellent bond was obtained in the case of 18% chromium, 12% nickel, 3% molybdenum stainless steel. Delamination of the titanium inner liner from the outer tubes was found in the 5%, 10% and 30% chromium tubes.

A chromium interlayer can be used on low-chromium or chromium-free steels to effect bonding of the titanium layer as shown by Test No. 11. The 0.38 micron thick chromium coating was electrodeposited on a 0.0254 mm thick nickel layer which had been electrodeposited on the inner surface of a 6.35 cm inside diameter, 8.9 cm outside diameter, 10.2 cm long steel tube.

TABLE II

Effect of Chromium Content on Bonding of Titanium (1090° C/4 hours)

| Test No. | Composition of Tube | Bonding |
|---|---|---|
| 4 | Fe-5% Cr | Delaminated |
| 5 | Fe-10% Cr | Delaminated |
| 8 | Fe-15% Cr | Excellent |
| 6 | Fe-20% Cr | Excellent |
| 9 | Fe-25% Cr | Excellent |
| 7 | Fe-30% Cr | Delaminated |
| 10 | Fe, 18% Cr, 12% Ni, 3% Mo | Excellent |
| 11 | Cr plate on steel | Excellent |

EXAMPLE IV

This example illustrates the use of the process of this invention for coating mild steel with a second metal. Type 316 stainless steel, nickel-base alloy, and 70/30 copper-nickel alloy powders having minus 100 U.S. Sieve Series size, and respective apparent densities of 2.80, 4.57 and 3.84 gm/cm$^3$ were used to coat the inside surface of mild steel tubes. The tubes had 8.9 cm outside diameter, 6.4 cm inside diameter and were 7.6 cm long. Sealed superplastic stainless steel bladders, 2.54 cm outside diameter, 7.3 cm long were used to compress the respective metal powders. The tubes, powders and bladders were assembled in the manner described previously, evacuated, sealed and subjected to the thermal treatments shown in Table III.

TABLE III

Preparation of Steel Tubes Lined With Stainless Steel, Nickel-Base Alloy and 70/30 Copper-Nickel Alloy

| Test No. | Composition of Metal Powder | Temp., °C | Time, hrs | Bond Quality | Density, gm/cm$^3$ |
|---|---|---|---|---|---|
| 12 | 18% Cr, 12% Ni, 3% Mo, Bal. Fe | 1090 | 1 | Excellent | 5.6 |
| 13 | 21% Cr, 9% Mo, 3.5% Cb, 5% Fe Bal. Ni | 1150 | 2 | Excellent | 7.0 |
| 14 | 70% Cu, 30% Ni | 1040 | 2 | Excellent | 5.7 |

Microscopic examination revealed excellent bonding of the coatings to the mild steel tubes. Full theoretical density was not achieved; however, the coatings exhibited at least 60% of theoretical density sufficient density for many applications. This is attributed to the spherical nature of the high-purity, argon-atomized powders used in these tests. One skilled in the art will appreciate that full theoretical density can be attained by using powdered metals having more desirable morphological characteristics and by suitable variation of temperature and time.

EXAMPLE V

This example illustrates the use of the process of this invention to prepare solid metal articles from metal powders. The assembly described previously as test No. 4 in Example III prepared with a Fe-5% Cr alloy tube was used to illustrate the method of producing a solid metal part.

Following expansion, the 10.2 cm long outer tube was machined in a lathe from 8.9 cm to 4.1 cm outside diameter. The remnants of the Fe-5% Cr outer tube and the bladder were removed from the assembly by dissolving in a 23% nitric acid, 5% hydrofluoric acid pickling solution.

The resultant titanium tube was representative of a solid metal article produced by the process of this invention. The tube diameter varied from 3.848 to 3.868 cm. The tubing wall thickness ranged from 1.448 to 2.108 cm since the metal bladder had not been located concentrically to the tubing wall during assembly.

The process of this invention is useful for coating curved or flat surfaces of a metal article with a second metal. The applied metal is intended to enhance the metal article by improving properties such as resistance to corrosion, oxidation, abrasion, etc. Coated articles of manufacture such as valves for handling corrosive chemicals, jet engine parts subject to elevated temperatures and oxidizing environments, and mining implements, can be prepared using the process of this invention. In addition, articles of manufacture similar to the aforedescribed can be prepared in solid form using the process of this invention.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A process for compressing and sintering metal powder into a solidified structure comprising: enclosing a body of metal powder within a pressure-resistant container; providing adjacent to said metal powder and within said pressure-resistant container, a superplastic metal bladder containing a heat-decomposable compound adapted upon decomposition to release a gas within said metal bladder to expand said metal bladder and apply pressure to said metal powder; heating said pressure-resistant container above the decomposition temperature of said heat-decomposable compound and in the sintering temperature region for said metal powder thereby providing internally generated pressure to expand said metal bladder and compress and sinter together said metal powder to provide said solidified structure characterized by density at least 60% of theoretical density.

2. A process for coating a metal surface with a metal coating which comprises: providing adjacent to said metal surface to be coated a body of metal powder having a composition to provide said metal coating; providing a superplastic metal bladder containing a heat-decomposable compound, adapted upon decomposition to release a gas, therein in contact with said body of metal powder; surrounding said metal powder, said metal surface to be coated and said metal bladder with a pressure-resistant container; and heating a resulting assembly to a temperature above the decomposition temperature of said heat-decomposable compound and in the sintering temperature region for said metal powder thereby providing internally generated pressure to expand said metal bladder and compress and sinter said metal powder against said metal surface to provide said metal coating characterized by density at least 60% of theoretical density.

3. A process as defined in claim 2 wherein said resulting assembly is heated to temperatures of from about 815° C to about 1315° C for from about one half hour to about 24 hours.

4. A process as defined in claim 3 wherein said heat-decomposable compound is a carbonate.

5. A process as defined in claim 4 wherein said metal bladder is prepared from a metal selected from the group consisting of superplastic stainless steel, superplastic nickel-containing alloys, and superplastic low alloy steels.

6. A process as defined in claim 5 wherein said body of metal powder is selected from a group consisting of titanium, titanium alloys, zirconium, stainless steels, abrasion-resistant alloys, nickel-containing alloys, and copper-nickel alloys.

7. A process as defined in claim 6 wherein said metal surface to be coated is selected from a group consisting of steels, maraging steels, stainless steels, cast irons, copper-nickel alloys, and nickel-containing alloys.

8. A process as defined in claim 7 wherein said pressure-resistant container is subject to an internal pressure of about 2 pascal.

9. A process as defined in claim 8 wherein said body of metal powder is selected from the group consisting of titanium and titanium alloys.

10. A process for hot isostatic pressing wherein the improvement comprises: providing a superplastic alloy bladder containing a heat-decomposable compound therein; providing adjacent to said superplastic alloy bladder, a body of metal powder in contact with said superplastic alloy bladder; providing adjacent to said body of metal powder in contact with said superplastic alloy bladder a molding surface conforming to the shape of said solid metal article; surrounding said superplastic alloy bladder, said body of metal powder and said molding surface with a pressure-resistant container; and heating a resulting assembly into a temperature region within which the metal of said superplastic alloy bladder exhibits superplastic behavior to decompose said heat-decomposable compound thereby providing an internally generated pressurized gas within said superplastic alloy bladder to expand said superplastic alloy bladder and compress and sinter said body of metal powder against said molding surface to form a sintered metal characterized by density at least 60% of theoretical density.

11. A process as described in claim 10 wherein said molding surface is prepared from a material selected from the group consisting of a metal and a ceramic.

* * * * *